US005122707A

United States Patent [19]

Nakanishi et al.

[11] Patent Number: 5,122,707

[45] Date of Patent: Jun. 16, 1992

[54] CATHODE IN A CATHODE RAY TUBE

[75] Inventors: Hisao Nakanishi; Kinjiro Sano; Toyokazu Kamata, all of Nagaokakyo; Keiji Watanabe, Kamakura; Masato Saito, Kamakura; Ryo Suzuki, Kamakura; Keiji Fukuyama, Kamakura; Masako Ishida, Kamakura, all of Japan

[73] Assignee: Mitsubishi Denki Kabushiki Kaisha, Tokyo, Japan

[21] Appl. No.: 725,761

[22] Filed: Jun. 28, 1991

Related U.S. Application Data

[63] Continuation of Ser. No. 305,407, Feb. 2, 1989, abandoned.

[30] Foreign Application Priority Data

Feb. 2, 1988 [JP] Japan ..... 63-23257

[51] Int. Cl.[5] ..... H01J 1/14

[52] U.S. Cl. ..... 313/346 R; 445/35; 445/46; 445/51; 427/78; 427/126.3

[58] Field of Search ..... 313/346 R; 252/521; 427/77, 78, 126.3; 445/35, 46, 51

[56] References Cited

U.S. PATENT DOCUMENTS

| | | | |
|---|---|---|---|
| 4,007,393 | 2/1977 | van Stratum et al. | 313/346 R |
| 4,518,890 | 5/1985 | Taguchi et al. | 313/346 R |
| 4,797,593 | 1/1989 | Saito et al. | 313/346 R |
| 4,864,187 | 9/1989 | Sano et al. | 313/346 R |

FOREIGN PATENT DOCUMENTS

| | | |
|---|---|---|
| 61-269828 | 11/1986 | Japan . |
| 61-271732 | 11/1986 | Japan . |
| 62-22347 | 1/1987 | Japan . |
| 62-88239 | 4/1987 | Japan . |
| 62-90820 | 4/1987 | Japan . |
| 62-90821 | 4/1987 | Japan . |
| 62-165832 | 7/1987 | Japan . |
| 62-165833 | 7/1987 | Japan . |
| 62-193031 | 8/1987 | Japan . |
| 62-193032 | 8/1987 | Japan . |
| 62-198029 | 9/1987 | Japan . |
| 63-310535 | 6/1988 | Japan . |
| 63-310536 | 6/1988 | Japan . |

*Primary Examiner*—Donald J. Yusko
*Assistant Examiner*—Michael Horabik
*Attorney, Agent, or Firm*—Birch, Stewart, Kolasch & Birch

[57] ABSTRACT

A cathode for use in electron tubes which comprises a base metal made of nickel as a principal component and having a surface on which a porous electron emissive layer is formed. The porous electron emissive layer is of a composition comprising 0.1 to 20 wt % (relative to the total weight of the porous electron emissive layer) of scandium oxide having a layered crystalline structure dispersed in an oxide of alkaline earth metal including at least barium. This cathode can be made by preparing a solution in which nitrocellulose is dissolved with the use of an organic solvent, mixing both of barium carbonate and scandium oxide having a layered crystalline structure into the solution to provide an suspension, pulverizing solid components of the suspension for the adjustment of particle size, and depositing the suspension on a surface of the base metal to form the electron emissive layer.

7 Claims, 3 Drawing Sheets

(X1,000)

(X 1,000)

CATHODE IN A CATHODE RAY TUBE

This application is a continuation, of application Ser. No. 07/305,407 filed on Feb. 2, 1989 now abandoned.

BACKGROUND OF THE INVENTION

1. Field of the Invention

The present invention generally relates to a cathode for use in electron tubes such as, for example, picture tubes or camera tubes and, more particularly, to an improvement in electron emissive material deposited on a surface of the cathode. The present invention also relates to a method of making the cathode of the type referred to above.

2. Description of the Prior Art

It is well known that the cathode in a cathode ray tube plays an important role of emitting electron beams when heated. An example of the prior art cathode is illustrated in FIG. 5 of the accompanying drawings in longitudinal sectional representation, reference to which will not be made for the discussion of the prior art.

The illustrated cathode is made of a base metal 1 containing as a principal component nickel mixed with a slight amount of reducing metal such as magnesium and/or silicon and is comprised of an open-ended tubular cathode body 1*a* and a cathode cap 1*b* mounted under interference fit on one open end of the tubular cathode body 1*a* so as to close the opening at such one open end. The cathode also comprises a heating element 2 built in the tubular cathode body 1*a* and an electron emissive layer 3 of electron emissive material deposited on an outer surface of the cathode cap 1*b*. The electron emissive material forming the electron emissive layer 3 is generally prepared by mixing a predetermined percent by weight of barium carbonate ($BaCO_3$) and a perdetermined percent by weight of scandium oxide ($SC_2O_3$) into a resinous solution, which is prepared by dissolving nitrocellulose with the use of an organic solvent, to provide a suspension, and then applying the suspension to the outer surface of the cathode cap 1*b* to form the electron emissive layer 3 by the use of a spray technique, an electro-deposition technique or a painting technique after the particle size of the solid components in the suspension has been adjusted.

As hereinabove discussed, in the prior art electron tubes, a so-called 'oxide cathode' is largely employed in which a layer of oxide of an alkaline earth metal containing barium (Ba) is deposited on the outer surface of the cathode cap 1*b*. The oxide cathode is operable as an electron emissive donor which emits electron beams when, after a carbonate of the alkaline earth metal has been transformed into an oxide upon pyrolysis, the reducing metal and the oxide react with each other to cause the oxide to form free atoms. The reason that the oxide cathode undergoes such a complicated process to emit the electron beams is because it employs as a starting material the carbonate which is chemically stable. More specifically, since the barium (Ba) is a highly active material although it has a relatively high power of emitting electrons, it tends to produce barium hydroxide ($Ba(OH)_2$) upon reaction with a water component contained in the air and, therefore, once the barium hydroxide is formed, it is difficult to cause the barium hydroxide to produce free barium (Ba) within the envelope of the electron tube.

The carbonates are available in the form of a single element such as barium carbonate ($BaCO_3$) and also in the form of a multi-element such as carbonates of alkaline earth metal (Ba, Sr, Ca)$CO_3$, and all of these compositions are identical so far as the fundamental mechanism of activation is concerned.

The cathode of the above described construction is incorporated in the envelope of the electron tube, which envelope is subsequently highly evacuated during an evacuating step. During the evacuation, the heating element 2 is activated to heat the interior of the envelope to a high temperature of about 1,000° C. When the envelope is so heated, the barium carbonate (BaCO3 ) undergoes the following pyrolysis.

$$BaCO_3 \rightarrow BaO + CO_2 \quad (1)$$

Carbon dioxide formed as a result of the reaction (1) above is discharged to the outside of the envelope. At the same time, resins such as nitrocellulose are also thermally decomposed into a gaseous body which is also discharged to the outside of the envelope together with the carbon dioxide. The reaction (1) brings about transformation of the barium carbonate ($BaCO_3$) of the electron emissive layer 3 into barium oxide (BaO). According to the prior art cathode, during the reaction (1) above taking place, reducing metals such as silicon (Si) and magnesium (Mg) which play an important role in reducing reaction are oxidized together with nickel (Ni) on the surface of the cathode under the oxidizing atmosphere within the envelope which contains carbon dioxide ($CO_2$) and oxygen ($O_2$).

FIG. 6 illustrates, on an enlarged scale, the joint between the base metal 1 and the electron emissive layer 3. In general, the barium oxide (BaO) transformed from the barium carbonate ($BaCO_3$) is in the form of an aggregation 9 of generally rod-shaped crystalline particles 8 of some micrometers to some tens micrometers in particle size, having fine interstices 10 defined among the crystalline particles 9 to form the electron emissive layer 3 which is porous in structure. At the interface between the electron emissive layer 3 and the base metal 1, the barium oxide (BaO) reacts with the reducing metals such as silicon (Si) and magnesium (Mg) to form free barium (Ba). These reducing metals are diffused into interstices 7 defined among crystalline particles 6 of nickel (Ni) forming the base metal 1 and undergoes a reducing reaction in the vicinity of the interface 11 between the base metal 1 and the electron emissive layer 3.

Examples of the reaction taking place at the interface 11 are illustrated below.

$$2BaO + Si \rightarrow 2Ba + SiO_2 \quad (2)$$

$$BaO + Mg \rightarrow Ba + MgO \quad (3)$$

The free barium (Ba) formed as a result of the reaction of the formula (2) participates in the electron emission as an electron emissive donor. At the same time, the following reaction takes place.

$$SiO_2 + 2BaO \rightarrow Ba_2SiO_4 \quad (4)$$

Although the electron emissive donor referred to hereinbefore is formed at the joint between the electron emissive layer 3 and the base metal 1 and moves through the interstices 10 in the electron emissive layer 3 shown in FIG. 6 to the outer surface of the electron emissive layer 3 for the participation in electron emission, the electron emissive donor is susceptible to evaporation and also to loss as a result of reaction with gaseous bodies of CO, $CO_2$, $O_2$ and $H_2O$ remaining within the envelope. Therefore, the electron emissive donor must be replenished by the above described reactions and, therefore, the reducing reaction takes place at all times during the operation of the cathode. In order to make a balance between the replenishment and the loss, the prior art cathode is required to be operated at about 800° C.

Also, as the reaction formulas (2) and (4) make it clear, during the operation of the cathode reaction products 12 such as $SiO_2$, $Ba_2SiO_4$ and others are formed at the interface 11 between the electron emissive layer 2 and the base metal 1 and are then accumulated in the interface 11 and the interstices 7 to form a barrier (hereinafter referred to as an intermediate layer) for the passage of silicon (Si). The presence of the barrier, that is, the intermediate layer, tends to delay the reaction making it difficult to form barium (Ba) which is the electron emissive donor.

In order to eliminate the above discussed problems, in any one of numerous patent literatures, for example, U.S. Pat. No. 4,518,890, issued May 21, 1985; U.S. Pat. No. 4,007,393, issued Feb. 8, 1977; U.S. patent application Ser. No. 864,566, filed May 16, 1986 now U.S. Pat. No. 4,864,187 (corresponding to a combination of Japanese Laid-open Patent Publications No. 61-269828 and No. 61-271732, published Nov. 29, 1986, and Dec. 2, 1986, respectively); U.S. patent application Ser. No. 886,777, filed Jul. 17, 1986 now U.S. Pat. No. 4,797,593 (corresponding to a combination of Japanese Laid-open Patent Publications No. 62-22347, No. 62- 165832, No. 62-165833, No. 62-90821, No. 62-198029, No. 62-193032, No. 62-90820, No. 62-193031 and No. 62-88239, published Jan. 30, Jul. 22, Jul. 22, Apr. 25, Sep. 1, Aug. 24, Apr. 25, Aug. 24, and Apr. 22, 1987, respectively); and U.S. patent application Ser. No. 204,818, filed Jun. 10, 1988 now U.S. Pat. No. 4,980,603 (corresponding to Japanese Laid-open Patent Publications (No. 63-310535 and No. 63-310536, both published Dec. 19, 1988), there is disclosed the use of scandium oxide ($Sc_2O_3$) dispersed in the electron emissive layer 3 so that the reaction products 12 such as $Ba_2SiO_4$ shown in FIG. 6 can be dissociated in the presence of scandium (Sc). However, it has been found that, since globular crystalline particles of the scandium oxide employed therein does not sufficiently disperse into the electron emissive layer 3, it often occurs that the dispersion of scandium oxide ($Sc_2O_3$) will bring about little effect as compared with the cathode in which no scandium oxide is dispersed, and therefore, the cathode in which the scandium oxide is dispersed will not give a stabilized effect.

As hereinbefore discussed, in the prior art cathode for use in the electron tubes, not only do both of the oxidization of the reducing metal and the accumulation of the reaction products occur during the reaction to decompose and reduce carbonates for the formation of the electron emissive donor, but also during the operation of the cathode the reaction products 12 tend to be accumulated in portions of the nickel crystalline interstices 7 in the vicinity of the base metal 1 and the electron emissive layer 3, particularly in the vicinity of the outer surface of the base metal 1 adjacent the electron emissive layer 3. Therefore, the dispersion of the reducing metal into the electron emissive layer 3 tends to be progressively disturbed to such an extent that no satisfactory electron emissive characteristic can be exhibited under a high electric current density for a prolonged time. In addition, since the resultant electron emissive layer 3 in the prior art cathode is not sufficiently porous in structure, the electron emission is not satisfactory.

SUMMARY OF THE INVENTION

The present invention has been devised with a view to substantially eliminating the above discussed problems inherent in the prior art cathodes for the electron tubes and is intended to provide an improved cathode wherein scandium oxide having a generally layered crystalline structure is dispersed in the electron emissive layer to make the latter sufficiently porous in structure so that a substantially stabilized electron emissive characteristic can be exhibited for a prolonged time.

In order to accomplish the above described object, the present invention provides a cathode for use in electron tubes which comprises a base metal made of nickel as a principal component and having a surface on which a porous electron emissive layer is formed. The porous electron emissive layer is of a composition comprising 0.1 to 20 wt % of scandium oxide having a layered crystalline structure dispersed in an oxide of alkaline earth metal including at least barium, said percent by weight being based on the total weight of the porous electron emissive layer.

Preferably, the base metal may contain a metal selected from the group consisting of magnesium and silicon. Also, the alkaline earth metal may contain a substance selected from the group consisting of strontium and calcium.

According to the present invention, the scandium oxide having the layered crystalline structure is dispersed in the oxide of alkaline earth metal to cause the resultant electron emissive layer to represent a porous structure. The scandium oxide can be easily pulverized into such fine particles that can be easily dispersed into the oxide of alkaline earth metal. Therefore, when the carbonate of the alkaline earth metal decomposes to form an oxide, or when the oxide (BaO) dissociates as a result of the reducing reaction, the intermediate layer having a relatively high resistance enough to disturb the emission of electrons and tending to be concentrated in the vicinity of the interface between the base metal and the electron emissive layer, such as found in the prior art cathode, will not be formed.

BRIEF DESCRIPTION OF THE DRAWINGS

In any event, the present invention will become more clearly understood from the following description of perferred embodiment thereof, when taken in conjunction with the accompanying drawings. However, the embodiment and the drawings are given only for the purpose of illustration and explanation, and are not to be taken as limiting the scope of the present invention in any way whatsoever, which scope is to be determined solely by the appended claims. In the drawings, like reference numerals denote like parts in the several views, and:

DETAILED DESCRIPTION OF THE EMBODIMENTS

Figure 1:
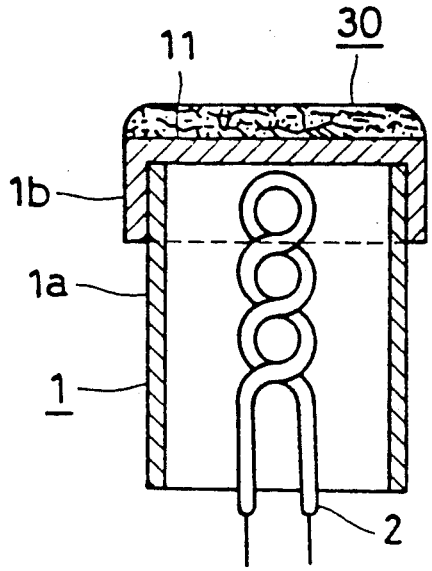
FIG. 1. is a schematic longitudinal sectional view of a cathode embodying the present invention.

Referring now to FIG. 1, there is shown, in longitudinal sectional representation, a cathode for use in a cathode ray tube. As is the case with the prior art cathode shown in and described with reference to FIG. 5, the cathode embodying the present invention is made of a base metal 1 comprising an open-ended tubular cathode body 1*a* and a cathode cap 1*b* mounted under interference fit on one open end of the tubular cathode body 1*a*. Both of the tubular cathode body 1*a* and the cathode cap 1*b* may be made of metallic material of a composition which may be identical with that used in the prior art cathode, i.e., of a composition containing, as a principal component, nickel added with a slight amount of reducing metals such as magnesium (Mg) and silicon (Si). Alternatively, in the practice of the present invention, only the tubular cathode body 1*a* may be made of nickel-chromium alloy ((Ni-Cr alloy). The cathode also comprises a heating element 2 enclosed in the tubular cathode body 1*a*.

An electron emissive layer formed in accordance with the present invention is generally identified by 30 and is deposited on an outer surface of the cathode cap 1*b*. the electron emissive layer 30 is made of material containing, as a principal component, one of ternary metallic oxides of alkaline earth metals which includes at least barium (Ba) and which may include strontium (Sr) and/or calcium (Ca) in addition to the barium (Ba), and 0.1 to 20 wt % of scandium oxide ($Sc_2O_3$) having a layered crystalline structure dispersed in the material, said percent by weight being relative to the total weight of the electron emissive layer 30. The scandium oxide ($Sc_2O_3$) having the layered crystalline structure, which may be used in the practice of the present invention has an average particle size within the range of 10 to 20 micrometers as measured with the use of Caulter counter and can readily be prepared by a general method of making metallic oxides. In other words, scandium oxide can be obtained by dissolving ore, containing scandium together with uranium, nickel or tin, with the use of an acid to provide a solution and then separating the scandium oxide from the solution with the use of a solvent.

The electron emissive layer 30 may be deposited on the outer surface of the cathode cap 1*b* in a manner substantially identical with the formation thereof according to the prior art. More specifically, the electron emissive layer 30 is formed by preparing a suspension containing respective predetermined percents by weight of barium carbonate ($BaCo_3$) and scandium oxide ($Sc_2O_3$) dissolved in a nitrocellulose solution with the use of an organic solvent (which percent by weight is the one required to permit the ternary carbonate to be transformed into an oxide), pulverizing the soild components of the suspension with the use of a ball mill for the adjustment of particle size thereof, and depositing it on the outer surface of the cathode cap 1*b* with the use of a spraying technique to form the electron emissive layer 30 to 100 micrometers in thickness. Instead of the use of the spraying method, either an electro-deposition technique or a painting technique may be employed for the deposition of the electron emissive layer 30. In any event, for the deposition of the electron emissive layer 30, any known method can be advantageously employed provided that the electron emissive layer 30 can be formed in a porous structure for the purpose of improving a favorable electron emission characteristic. For this reason, the use of the spraying technique is preferred.

Figure 2:
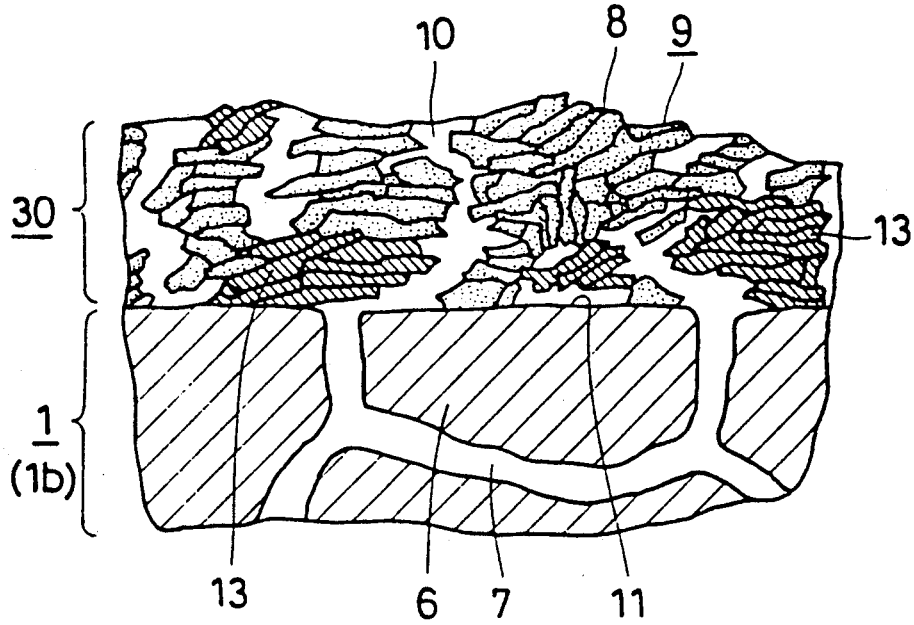
FIG. 2. is a sectional view, on an enlarged scale, showing the joint between a base metal and an electron emissive layer, both forming the cathode according to the present invention.
Figure 6:
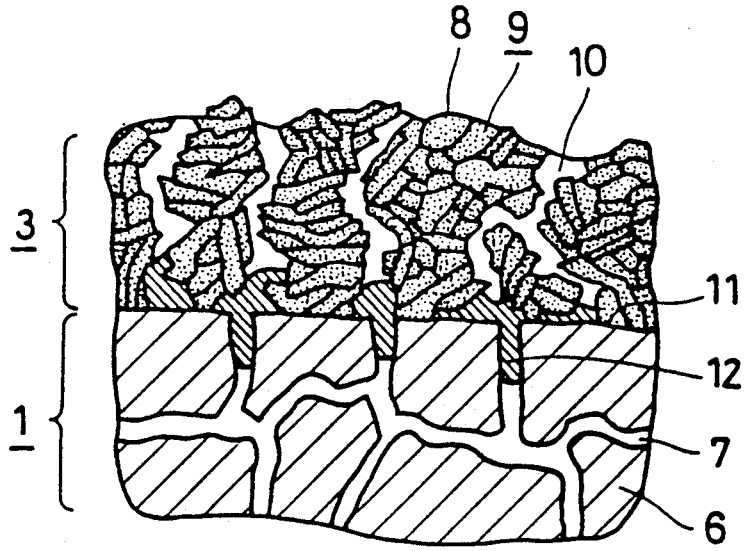
Fig. 6 Prior Art
FIG. 6. is a sectional view, on an enlarged scale, showing the joint between the base metal and the electron emissive layer in the prior are cathode.

FIG. 2. illustrates a diagrammatic sectional representation of the joint between the base metal 1 and the electron emissive layer 30 formed according to the present invention. As is the case with the diagrammatic sectional representation of FIG. 6, reference numeral 6 represents the crystalline particles of nickel (Ni) forming the base metal 1; reference numeral 7 represents the interstices defined among the nickel crystalline particles 6; reference numeral 8 represents the generally rod-shaped crystalline particles of barium oxide; reference numeral 9 represents the aggregation of the crystalline particles 8; and reference numeral 11 represents the interface between the base metal 1 and the electron emissive layer 30.

Reference numeral 13 shown in FIG. 2 represents crystalline particles of the scandium oxide having the layered crystalline structure which has been dispersed in the electron emissive layer 30 a in quantity of 0.1 to 20 wt % relative to the total weight of the electron emissive layer 30 so as to form the interstices 10 necessary for the resultant electron emissive layer 30 to exhibit a favorable electron emission performance, that is, so as to form the porous electron emissive layer 30.

Figure 3:
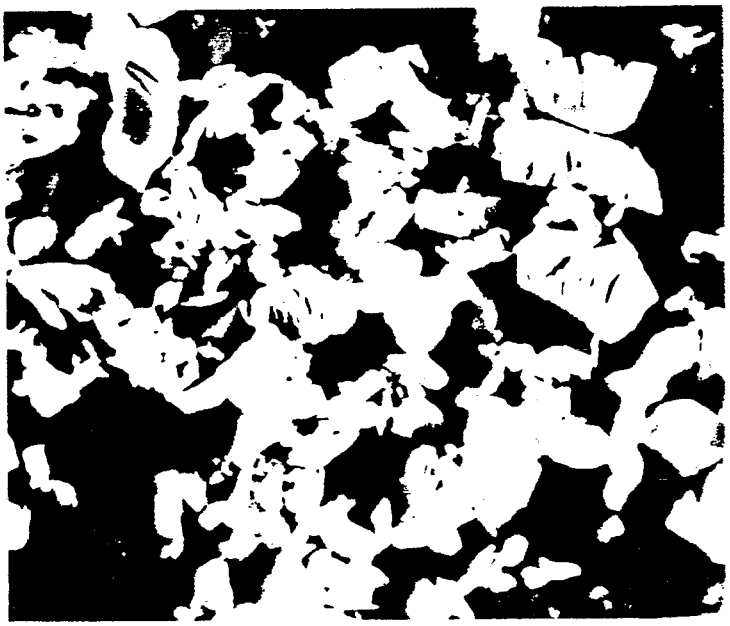
FIG. 3. is a photomicrograph showing the crystalline structure of the electron emissive layer in which scandium oxide having a layered crystalline structure is dispersed.

A photomicrograph showing the crystalline structure of the electron emissive layer 30 formed in accordance with the present invention, taken at a magnification factor of 1,000 with the use of an electron microscope, is presented in FIG. 3. Referring to the photomicrograph of FIG. 3, white areas represent crystalline particles of the scandium oxide having the layered crystalline structure whereas black areas represent the interstices 10 formed among the crystalline particles 13 of the scandium oxide. The presence of the interstices 10 renders the electron emissive layer 30 according to the present invention to represent the porous structure as discussed with reference to FIG. 2.

Figure 4:
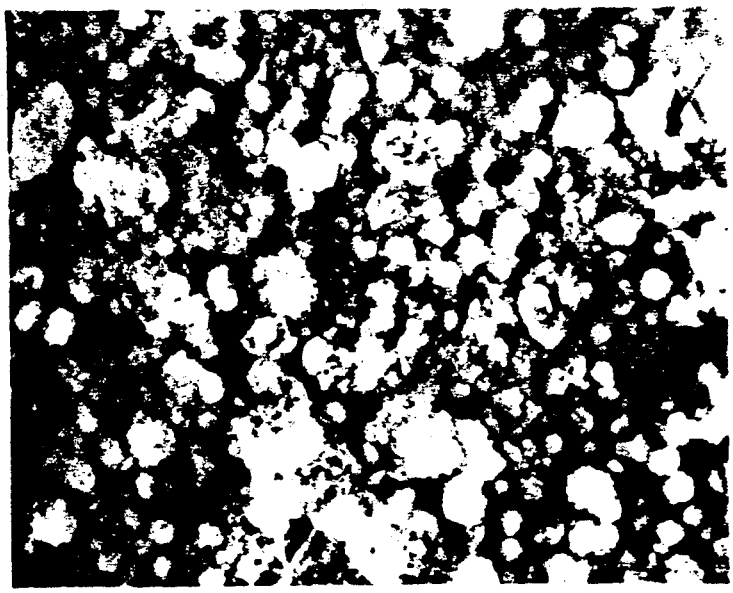
FIG. 4 PRIOR ART
FIG. 4. is a photomicrograph showing the crystalline structure of the electron emissive layer in which scandium oxide having a globular crystalline structure is dispersed.
Figure 5:
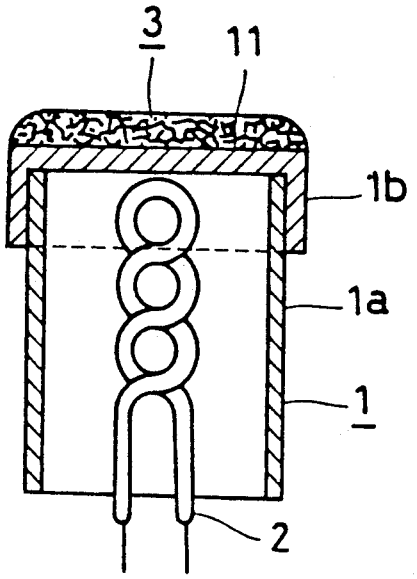
Fig. 5 Prior Art
FIG. 5. is schematic longitudinal sectional view of the prior art cathode.

The photomicrograph shown in FIG. 4, taken at a magnification of 1,000 with the use of an electron microscope, illustrates the crystalline structure of scandium oxide used to form the electron emissive layer 3 in the prior art cathode shown in FIG. 5. In the photomicrograph of FIG. 4, white areas represent globular crystalline particles of the scandium oxide having a globular crystalline structure and black areas represent interstices among the crystalline particles of the scandium oxide.

Comparison between the photomicrographs of FIG. 3 and FIG. 4 makes it clear that, because of the globular crystalline structure of the scandium oxide used in the electron emissive layer in the prior art cathode, the interstices 10 among the scandium oxide crystals in the prior art cathode are more reduced in surface area than the interstices 10 among the scandium oxide crystals in the cathode of the present invention and are substantially filled up without rendering the electron emissive layer 3 to represent a porous structure.

Activation of the electron emissive layer 30 so formed in accordance with the present invention, which is necessitated to form the electron emissive donor, will now be discussed.

The cathode, with the electron emissive layer 30 formed on the outer surface of the cathode cap 1*b*, is during the manufacture of the cathode ray tube incorporated in an envelope. The envelope with the cathode incorporated therein is then subjected to an evacuating process to evacuate the envelope to establish a vacuum therein. During the evacuation, the heating element 2 is activated to heat the interior of the envelope to about 1,000° C. thereby causing the barium carbonate ($BaCO_3$) to undergo the following reaction.

$$BaCO_3 \rightarrow BaO + CO_2 \quad (1)$$

Carbon dioxide ($CO_2$) formed as a result of the reaction (1) above is discharged to the outside of the envelope. At the same time, nitrocellulose is also thermally decomposed into a gaseous body which is discharged to the outside of the envelope together with the carbon dioxide. The reaction (1) results in transformation of the barium carbonate ($BaCO_3$) of the electron emissive layer 3 into barium oxide (BaO).

The barium oxide (BaO) transformed from the barium carbonate ($BaCO_3$) as a result of the reation (1) above reacts with the reducing metals such as silicon (Si) and magnesium (Ma), diffused from the base metal 1, to form free barium (Ba) during the activation carried out to reduce the barium oxide. These reducing metals are diffused into the interstices 7 defined among crystalline particles 6 of nickel (Ni) forming the base metal 1 and undergoes a reducing reaction in the vicinity of the interface 11 between the base metal 1 and the electron emissive layer 3.

An example of the reaction taking place at the interface 11 is illustrated belwo.

$$2BaO + Si \rightarrow 2Ba + SiO_2 \quad (2)$$

The free barium (Ba) formed as a result of the reaction (2) participates the electron emission as an electron emissive donor. At the same time, the following reaction takes place.

$$SiO_2 + 2BaO \rightarrow Ba_2SiO_4 \quad (4)$$

As hereinbefore described, the electron emissive donor is formed at the joint between the electron emissive layer 30 and the base metal 1 and moves through the interstices 10 in the electron emissive layer 30 shown in FIG. 2 to the outer surface of the electron emissive layer 30 for the participation is electron emission, the electron emissive donor is susceptible to evaporation and also to loss as a result of reaction with gaseous bodies of CO, $CO_2$, $O_2$ and $H_2O$ remaining within the envelope. Therefore, the electron emissive donor must be replenished by the above described reactions and, therefore, the reducing reaction takes place at all times during the operation of the cathode. In order to make a balance between the replenishment and the loss, the cathode is required to be operated at about 800° C. The above mentioned process is the same as that of the prior art.

Barium silicate ($Ba_2SiO_4$) contained in an intermediate layer which is a product resulting from the reaction of the formula (4) above reacts with the scandium oxide ($Sc_2O_3$) contained in the electron emissive layer 30 as shown by the following reaction formula.

$$Sc_2O_3 + 10Ni \rightarrow 2ScNi_5 + 3O \quad (5)$$

$$9Ba_2SiO_4 + 16ScNi_5 \rightarrow 4Ba_3Sc_4O_9 + 6Ba + 9Si + 80Ni \quad (6)$$

By these reactions the barium silicate ($Ba_2SiO_4$) is decomposed through the scandium oxide ($Sc_2O_3$) and nickel (Ni) and, therefore, no intermediate layer will be formed at the interface between the electron emissive layer 30 and the base metal 1.

Thus, according to the present invention, contrary to the prior art cathode, there is no possibility that the accumulation of the reaction product such as barium silicate ($Ba_2SiO_4$) in the interface or joint between the base metal 1 and the electron emissive layer 30 and also in the interstices 7 among the crystalline particles forms a barrier for the passage of the reducing metal such as silicon (Si) to such an extent as to result in a delay in reducing reaction, thereby bringing about a difficulty in formation of the free barium (Ba) which acts as a donor. In addition, according to the present invention, since no intermediate layer is formed as hereinabove discussed, the flow of the electron beams will not be disturbed and, therefore, the cathode can be operated at a high current density.

In order to ascertain the extent to which the flow of the electron beams is disturbed by the presence or absence of the intermediate layer formed at the interface between the electron emissive layer and the base metal, a series of experiments have been conducted to compare and evaluate the prior art cathode and the cathode according to the present invention, three of each cathode used in the color cathode ray tubes, under conditions in which both of the prior art cathodes and the cathodes according to the present invention were forcibly accelerated at 3 A/cm$^2$ of current density for 6,000 hours. Results of the experiments have shown that 50% deterioration relative to and initial value was found in the prior art cathodes, in which no scandium oxide has not been dispersed, when 6,000 hours has passed, whereas 70% of the initial value was maintained, that is, only 30% deterioration was found, in the cathodes according to the present invention when 6,000 hours has passed. Thus, the superiority of the cathodes according to the present invention to the prior art cathodes is the outcome of the effects brought about by the use of the scandium oxide ($Sc_2O_3$) having the layered crystalline structure within the range of 0.1 to 20 wt %.

If the amount of the scandium oxide added is smaller than the lowermost limit of 0.1 wt %, the scandium oxide will be dispersed insufficiently and it will not bring about any appreciable effect. On the other hand, if the amount of the scandium oxide added is greater than the uppermost limit of 20 wt %, the electron beams cannot be sufficiently obtained from the cathode when and after the latter has been activated and, therefore, the cathode cannot be utilized in practice. More preferably, the range of percentage by weight of the scandium oxide ($Sc_2O_3$) is 1 to 10.

As hereinbefore fully described, the present invention is such that the cathode for use in electron tubes comprises a base metal made of nickel as a prinicipal component and having a surface on which a porous electron emissive layer is formed and that the porous electron emissive layer is of a composition comprising 0.1 to 20 wt % of scandium oxide having a layered crystalline structure dispersed in an oxide of alkaline earth metal including at least barium. Therefore, when the carbonates of alkaline earth metal is transformed into oxide, or when the oxide so transformed is dissociated as a result of the reducing reaction, any composite oxide of the reducing metal, that is, the intermediate layer having a high resistance enough to disturb the emission of electrons, will not be formed. Moreover, because of the porous structure exhibited by the electron emissive layer, the free atoms can be readily replenished enough to permit the cathode to be operated stable at a high current density for a prolonged time for the emission of electrons.

Although the present invention has fully been described in connection with the preferred embodiment thereof with reference to the accompanying drawings used only for the purpose of illustration, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

We claim:

1. A cathode for use in electron tubes which comprises a base metal made of nickel as a principal component and having a surface on which a porous electron emissive layer is formed, said porous electron emissive layer being of a composition comprising 0.1 to 20 wt % of scandium oxide having a layered crystalline structure dispersed in an oxide of alkaline earth metal including at least barium, wherein the scandium oxide has an average particle size within the range of 10 to 20 micrometers and is dispersed in the oxide of alkaline earth metal by preparing a solution in which nitrocellulose is dissolved with the use of an organic solvent;

mixing the oxide of alkaline earth metal and scandium oxide having a layered crystalline structure into the solution to provide a suspension; and pulverizing solid components of the suspension for the adjustment of particle size.

2. The cathode as claimed in claim 1, wherein the base metal contains a material selected from the group consisting of magnesium and silicon.

3. The cathode as claimed in claim 1, wherein the alkaline earth metal contains a material selected from the group consisting of strontium and calcium.

4. The cathode as claimed in claim 1, wherein the scandium oxide is present in an amount of 1 to 10 wt %.

5. The cathode as claimed in claim 1, wherein said porous electron emissive layer has a thickness of 30 to 100 micrometers.

6. The cathode as claimed in claim 1, wherein the oxide of alkaline earth metal is barium oxide.

7. The cathode as claimed in claim 1, wherein the solid components of the suspension are pulverized using a ball mill.

* * * * *